US007083836B2

(12) United States Patent
Romano, Jr. et al.

(10) Patent No.: US 7,083,836 B2
(45) **Date of Patent: *Aug. 1, 2006**

(54) INK JET RECORDING ELEMENT AND PRINTING METHOD

(75) Inventors: Charles E. Romano, Jr., Rochester, NY (US); Richard J. Kapusniak, Webster, NY (US); Lori J. Shaw-Klein, Rochester, NY (US); Terry C. Schultz, Hilton, NY (US); Peter J. Ghyzel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 111 days.

This patent is subject to a terminal disclaimer.

(21) Appl. No.: 10/705,057

(22) Filed: Nov. 10, 2003

(65) Prior Publication Data

US 2005/0099477 A1 May 12, 2005

(51) Int. Cl.
*B41M 5/00* (2006.01)

(52) U.S. Cl. ..... 428/32.15; 347/105; 347/106; 428/32.34; 428/32.36; 428/32.37

(58) Field of Classification Search ..... 428/32.25, 428/32.34, 32.37
See application file for complete search history.

(56) References Cited

U.S. PATENT DOCUMENTS

| | | | | |
|---|---|---|---|---|
| 6,254,845 | B1 | 7/2001 | Ohashi et al. | |
| 6,341,560 | B1 | 1/2002 | Shah et al. | |
| 6,447,114 | B1 * | 9/2002 | Sunderrajan et al. | 347/105 |
| 6,548,149 | B1 * | 4/2003 | Liu et al. | 156/235 |
| 6,596,250 | B1 * | 7/2003 | Greenwood et al. | 423/335 |
| 6,632,489 | B1 * | 10/2003 | Watanabe et al. | 428/32.34 |
| 2002/0051931 | A1 | 5/2002 | Mori et al. | |
| 2003/0112311 | A1 | 6/2003 | Naik et al. | |

FOREIGN PATENT DOCUMENTS

| | | |
|---|---|---|
| EP | 0967088 | 12/1999 |
| EP | 1048479 | 11/2000 |
| FR | 2805204 | 8/2001 |
| JP | 11078218 | 3/1999 |

OTHER PUBLICATIONS

Shin-ichiro Wada, "Synthesis of Allophane and Imogolite, Reactions between Silicic Acid and Aluminum Ions in Dilute Aqueous Solutions," Journal of the Clay Science Society of Japan, vol. 25, No. 2, pp. 53-60, 1985.

* cited by examiner

*Primary Examiner*—Pamela R. Schwartz
(74) *Attorney, Agent, or Firm*—Chris P Konkol

(57) ABSTRACT

An ink jet recording element comprising a support having thereon, in order, a hydrophilic absorbing layer and a polymeric overcoat layer comprising particles of a substantially amorphous synthetic aluminosilicate. Such recording elements exhibit improved humidity keeping and smudge resistance, while maintaining good differential gloss.

19 Claims, No Drawings

INK JET RECORDING ELEMENT AND PRINTING METHOD

FIELD OF THE INVENTION

The present invention relates to an ink jet recording element and a printing method using the element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink-recording element typically comprises a support having on at least one surface thereof an ink-receiving or image-forming layer, and includes those intended for reflection viewing, which have an opaque support, and those intended for viewing by transmitted light, which have a transparent support.

In order to achieve and maintain high quality images on such an image-recording element, the recording element must exhibit no banding, bleed, coalescence, or cracking in inked areas; exhibit the ability to absorb large amounts of ink and dry quickly to avoid blocking; exhibit high optical densities in the printed areas; exhibit freedom from differential gloss; exhibit high levels of image fastness to avoid fade from contact with water or radiation by daylight, tungsten light, or fluorescent light or exposure to gaseous pollutants; and exhibit excellent adhesive strength so that delamination does not occur.

Titanium dioxide, zinc oxide, silica and polymeric beads such as crosslinked poly(methyl methacrylate) or polystyrene beads have been used in the receiving layer or layers used in ink recording elements for the purposes of contributing to the non-blocking characteristics of the recording elements or to control the smudge resistance thereof.

U.S. Pat. No. 6,447,114 issued Sep. 10, 2002 to Sunderrajan et al., titled "Ink Jet Printing Method," uses inorganic pigments in a porous overcoat. The amount of inorganic pigment used may range from about 50 to about 95% of the image-receiving layer. Such particles include silica, alumina, calcium carbonate, modified kaolin clay, montmorillinite clay, hydrotactite clay, and laponite clay.

U.S. Patent Publication No. 2003/0112311 A1 published Jan. 16, 2003 by Becker et al., titled "Method For Decoding A Data Signal," discloses an ink-receptive composition comprising a filler, binder such as polyvinyl alcohol, cationic polymer.

U.S. Pat. No 6,341,560 issued Jan. 29, 2002 to Shah et al., titled "Imaging And Printing Methods Using Clay-containing Fluid Receiving Element," discloses a lithographic imaging member that is prepared by applying an ink-jetable fluid to a fluid-receiving element that includes a clay-containing fluid-receiving surface layer. Useful clays that are used are either synthetic or naturally occurring materials, including but not limited to kaolin (aluminum silicate hydroxide) and many other clays such as serpentine, montmorillonites, illites, glauconite, chlorite, vermiculites, bauxites, attapulgites, sepiolites, palygorskites, corrensites, allophanes, imoglites, and others.

Aluminosilicates are known in various forms. For example aluminosilicate polymers are known in fiber form, such as imogolite. Imogolite is a filamentary, tubular and crystallized aluminosilicate, present in the impure natural state in volcanic ashes and certain soils; it was described for the first time by Wada in Journal of Soil Sci. 1979, 30(2), 347–355. In comparison, allophanes are in the form of substantially amorphous particles.

Naturally occurring allophane is a series name used to describe clay-sized, short-range ordered aluminosilicates associated with the weathering of volcanic ashes and glasses. Such natural allophane commonly occurs as very small rings or spheres having diameters of approximately 35–50 Å (3.5 to 5.0 nm). This morphology is characteristic of allophane, and can be used in its identification. Naturally occurring allophanes have a composition of approximately $Al_2Si_2O_5.nH_2O$. Some degree of variability in the Si:Al ratios is present. Wada reports Si:Al ratios varying from about 1:1 to 2:1. Because of the exceedingly small particle size of allophane and the intimate contact between allophane and other clays (such as smectites, imogolite, or non-crystalline Fe and Al oxides and hydroxides and silica) in the soil, it has proven very difficult to accurately determine the composition of naturally occurring allophane. Allophane usually gives weak XRD peaks at 2.25 and 3.3 Å. Identification is commonly made by infrared analyses or based on transmission electron morphology.

A limited amount of isomorphous substitution occurs in natural allophane. The most common type is the substitution of Fe for Al. In some cases, the color of this natural allophane is dark yellow due to the presence of Fe3+, the presence of which can interfere with making Raman spectrum of the natural allophane due to the presence of this Fe3+ traces (fluoresence under the laser excitation).

Little permanent charge is typically present in natural allophane. The majority of the charge is variable charge, and both cation and anion exchange capacities exist, with the relative amounts depending on the pH and ionic strength of the soil chemical environment.

Synthetic allophane, like natural allophane, is also a substantially amorphous material having weak XRD signals. The particle size (average diameter) typically is in the range of about 4 to 5.5 nm. Due to their small size, it is difficult to obtain a photo of a single unit of synthetic allophane, but they commonly appear substantially spherical, which spheres are usually hollow. The zeta potential of synthetic allophane is positive, which is in the range of other pure alumina materials. There is data supporting the chemical anisotropy of synthetic allophane, with aluminols at the outer surface, silanols wrapping the inner surface. Aluminosilicate polymers, in spherical particle form, that can be described as synthetic allophanes are disclosed in U.S. Pat. No. 6,254,845 issued Jul. 3, 2001 to Ohashi et al., titled "Synthesis Method Of Spherical Hollow Aluminosilicate Cluster," which patent describes an improved method for preparing hollow spheres of amorphous aluminosilicate polymer similar to natural allophane. This patent also refers to Wada, S., Nendo Kagaku ( Journal of the Clay Science Soc. of Japan), Vol. 25, No. 2, pp. 53–60, 1985) for another synthesis of amorphous aluminosilicate superfine particles. The aluminosilicate polymers in U.S. Pat. No. 6,254,845 to Ohashi et al. are within a range of 1–10 nm, shaped as hollow spheres, and are observed to form hollow spherical silicate "clusters" or aggregates in which pores are formed. The patent to Ohashi et al. states that powder X-ray diffraction reveals two broad peaks close to 27° and 40° at 2θ on the Cu—$K_\alpha$ line, which correspond to a non-crystalline (substantially amorphous) structure and which is characteristic of spherical particles referred to as allophane. In addition, observations under a transmission microscope reveal a state in which hollow spherical particles with diameters of 3–5 nm are evenly distributed.

Regarding the Al/Si ratio, it is believed that sufficient silanol group is needed to form an homogeneous layer of silicate on the face of the proto gibbsite sheet, sufficient to curl this protogibbsite sheet and finally allowing a closo structure to be obtained The Al/Si ratio, therefore, has to be in the range 1 to 4.

Two types of synthetic allophane, referred to as hybrid and classical, are disclosed in French Applications FR 0209086 and FR 0209085 filed on Jul. 18, 2002. Hybrid Synthetic allophanes show the same fingerprints as classical allophane with some additional bands due to the presence of organic groups.

As indicated above, synthetic and natural allophane are generally non-crystalline materials, which include both amorphous and short-range ordered materials such as microcrystalline materials. Amorphous materials are at the opposite extreme from crystalline materials: they do not have a regularly repeating structure, even on a molecular scale. Their compositions may be regular or, as is more commonly the case, they may have a large degree of variability. They do not produce XRD peaks. Since the term amorphous is sometime applied to materials that are truly amorphous, like volcanic glass, the term x-ray amorphous or simply non-crystalline can be used to describe allophanes and other short-range ordered materials that may show weak XRD peaks and hence not completely amorphous. Such aluminosilicate materials will be referred to herein as substantially amorphous. Short-range ordered materials can sometimes be identified by XRD or selective dissolution in conjunction with differential XRD.

While a wide variety of different types of image recording elements for use with ink printing are known, there are many unsolved problems in the art and many deficiencies in the known products, which have severely limited their commercial usefulness. A major challenge in the design of an image-recording element is to provide humidity keeping and smudge resistance, especially for swellable, non-porous recording elements.

It is an object of this invention to provide a multilayer ink recording element that has excellent image quality and improved humidity keeping and smudge resistance.

Still another object of the invention is to provide a printing method using the above-described element.

SUMMARY OF THE INVENTION

These and other objects are achieved by the present invention which comprises an ink jet recording element comprising a support having thereon a polymeric overcoat layer comprising a hydrophilic polymer and particles of an aluminosilicate. This overcoat is above at least one hydrophilic absorbing layer, preferably two such layers.

Such recording elements, which comprise non-porous (swellable) overcoat and hydrophilic absorbing layers, exhibit improved humidity keeping and smudge resistance, while maintaining good gloss.

The ink jet elements of the invention have excellent image quality, humidity keeping and smudge resistance.

A preferred embodiment of the present invention involves an inkjet recording element comprising in order, on a support, a gelatin-containing base layer, an inner layer, and a synthetic-allophane-containing overcoat. In a preferred embodiment both the overcoat and the inner layer comprise, as binder, polyvinyl alcohol. Preferably, both the inner layer and the base layer comprise different cationic polymers, respectively a polyurethane and an acrylic latex.

Another embodiment of the invention relates to an inkjet printing method comprising the steps of: A) providing an ink jet printer that is responsive to digital data signals; B) loading the printer with the ink jet recording element described above; C) loading the printer with an ink jet ink; and D) printing on the ink jet recording element using the ink jet ink in response to the digital data signals.

As used herein, the terms "over," "above," and "under" and the like, with respect to layers in the inkjet media, refer to the order of the layers over the support, but do not necessarily indicate that the layers are immediately adjacent or that there are no intermediate layers.

DETAILED DESCRIPTION OF THE INVENTION

As noted above, at least one hydrophilic absorbing layer that may be used in the invention comprises a natural or synthetic polymer. Preferred is a hydrophilic absorbing layer comprising gelatin or poly (vinyl alcohol) (PVA). This layer may also contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly(ethylene imine), poly(acrylic acid), poly(methacrylic acid), n-vinyl amides including polyacrylamide and polyvinyl pyrrolidinone (PVP), and poly(vinyl alcohol) derivatives and copolymers, such as copolymers of poly(ethylene oxide) and poly(vinyl alcohol) (PEO-PVA).

The gelatin used in the present invention may be made from animal collagen, but gelatin made from pig skin, cow skin, or cow bone collagen is preferable due to ready availability. The kind of gelatin is not specifically limited, but lime-processed gelatin, acid processed gelatin, amino group inactivated gelatin (such as acetylated gelatin, phthaloylated gelatin, malenoylated gelatin, benzoylated gelatin, succinylated gelatin, methyl urea gelatin, phenylcarbamoylated gelatin, and carboxy modified gelatin), or gelatin derivatives (for example, gelatin derivatives disclosed in JP Patent publications 38-4854/1962, 39-5514.1964, 40-12237/1965, 42-26345/1967, and 2-13595/1990; U.S. Pat. Nos. 2,525,753, 2,594,293, 2,614,928, 2,763,639, 3,118,766, 3,132,945, 3,186,846, 3,312,553; and GB Patents 861,414 and 103, 189) can be used singly or in combination. Most preferred are pigskin or modified pigskin gelatins and acid processed osseine gelatins due to their effectiveness for use in the present invention.

The hydrophilic absorbing layer or layers must effectively absorb both the water and humectants commonly found in printing inks as well as the recording agent. In a preferred embodiment of the invention, two hydrophilic absorbing layers under the overcoat layer are present, the above-mentioned inner layer and base layer, the latter being closer to the support and the former being under the overcoat layer. In one embodiment of the present invention, the base layer comprises gelatin, and the other comprises one or more hydrophilic material selected from naturally-occurring hydrophilic colloids and gums such as albumin, guar, xantham, acacia, chitosan, starches and their derivatives, functionalized proteins, functionalized gums and starches, cellulose ethers and their derivatives, polyvinyloxazoline, such as poly(2-ethyl-2-oxazoline) (PEOX), non-modified gelatins, polyvinylmethyloxazoline, polyoxides, polyethers, poly(ethylene imine), n-vinyl amides including polyacrylamide and polyvinyl pyrrolidinone (PVP), poly(vinyl alcohol) and poly(vinyl alcohol) derivatives and copolymers, such as copolymers of poly(ethylene oxide) and poly(vinyl alcohol) (PEO-PVA), polyurethanes, and polymer latices such as polyesters and acrylates. Derivitized poly(vinyl alcohol) includes, but is not limited to, polymers having at least one hydroxyl group replaced by ether or ester groups which may be used in the invention may comprise an acetoacetylated poly(vinyl alcohol) in which the hydroxyl groups are esterified with acetoacetic acid.

In another preferred embodiment of the invention, the hydrophilic absorbing layers comprise a first hydrophilic absorbing layer, a base layer comprising gelatin, and at least one upper layer or second hydrophilic absorbing layer (also referred to as the "inner layer"), located between the base layer and the overcoat layer, comprising poly(vinyl alcohol). These embodiments provide enhanced image quality.

As noted above, the poly(vinyl alcohol) employed in the invention has a degree of hydrolysis of at least about 50% and has a number average molecular weight of at least about 45,000. In a preferred embodiment of the invention, the poly(vinyl alcohol) has a degree of hydrolysis of about 70 to 99%, more preferably about 75 to 90%. Commercial embodiments of such a poly(vinyl alcohol) include Gohsenol® AH-22, Gohsenol® AH-26, Gohsenol® KH-20, and Gohsenol® GH-17 from Nippon Gohsei and Elvanol® 52-22 from DuPont (Wilmington, Del.).

In one particularly preferred embodiment, an inner layer comprises a mixture of poly(vinyl alcohol) and a cationic polyurethane latex dispersion, such as Witcobond® 213, in a ratio of 50:50 to 95:5 PVA to polyurethane. A chelating agents such as EDTA (ethylene diamine tetraacetic acid), in an amount of 0.01 to 2.0 weight percent, preferably about 0.4 weight percent can be included in the composition for the inner layer (and also in the overcoat when PVA is used as the binder) to prevent crosslinking with metal contaminants or other undesirable reactions.

In general, the dry layer thickness of a base layer, preferably a gelatin-containing base layer, is preferably from 5 to 60 microns (more preferably 6 to 15 microns), below which the layer is too thin to be effective and above which no additional gain in performance is noted with increased thickness. The dry layer thickness of the inner layer, preferably comprising a poly(vinyl alcohol)/cationic polyurethane mixture, is preferably from 0.5 to 5 μm (more preferably 1 to 2 microns). The preferred dry coverage of the overcoat layer is from 0.5 to 5 μm (more preferably 0.5 to 1.5 microns) as is common in practice.

The binder for the overcoat can be any of the polymers mentioned above for the hydrophilic absorbing layers. In a preferred embodiment of the invention, the overcoat comprises poly(vinyl alcohol), hydroxypropyl cellulose, hydroxypropyl methyl cellulose, gelatin, and/or a poly(alkylene oxide). In a still more preferred embodiment, the hydrophilic binder in the overcoat is poly(vinyl alcohol). This layer may also contain other hydrophilic materials such as cellulose derivatives, e.g., cellulose ethers like methyl cellulose (MC), ethyl cellulose, hydroxypropyl cellulose (HPC), sodium carboxymethyl cellulose (CMC), calcium carboxymethyl cellulose, methylethyl cellulose, methylhydroxyethyl cellulose, hydroxypropylmethyl cellulose (HPMC), hydroxybutylmethyl cellulose, ethylhydroxyethyl cellulose, sodium carboxymethyl-hydroxyethyl cellulose, and carboxymethylethyl cellulose, and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide (HEC-LDME), such as Quatrisoft® LM200 (Amerchol Corp.) as well as hydroxyethyl cellulose grafted with alkyl $C_{12}$–$C_{14}$ chains.

The overcoat is non-porous. Consequently, the total amount of particles in the overcoat is preferably not more than about 20 weight percent total solids and the amount of binder is at least 80 percent. The overcoat comprises from 0.1 to 15 percent by weight solids of particles of a synthetic aluminosilicate material, preferably about 1 to 10, more preferably 3 to 7 wt % of the overcoat solids. The aluminosilicate is similar to natural allophane, but is a synthetically produced material not derived from a natural or purified natural aluminosilicate material and that is substantially amorphous in the form of spheres or rings, preferably substantially spherical spheres 1 to 10 nm in average diameter. It is a polymeric aluminosilicate material having the formula:

$$Al_xSi_yO_a(OH)_b.nH_2O$$

where the ratio of x:y is between 0.5 and 4, a and b are selected such that the rule of charge neutrality is obeyed; and n is between 0 and 10.

In a preferred embodiment, the polymeric aluminosilicate has the formula:

$$Al_xSi_yO_a(OH)_b.nH_2O$$

where the ratio of x:y is between 1 and 3.6, preferably 1 to 3, more preferably 1 to 2, and a and b are selected such that the rule of charge neutrality is obeyed; and n is between 0 and 10. More preferably, it is a substantially amorphous aluminosilicate, spherical or ring shaped, with a general molar ratio of Al to Si not more than 2:1.

The polymeric aluminosilicate can be obtained by the controlled hydrolysis by an aqueous alkali solution of a mixture of an aluminum compound such as halide, perchloric, nitrate, sulfate salts or alkoxides species $Al(OR)_3$, and a silicon compound such as alkoxides species, wherein the molar ratio Al/Si is maintained between 1 and 3.6 and the alkali/Al molar ratio is maintained between 2.3 and 3. Such materials are described in French patent application FR 02/9085, hereby incorporated by reference in its entirety.

The polymeric aluminosilicate can be obtained by the controlled hydrolysis by an aqueous alkali solution of a mixture of an aluminum compound such as halide, perchloric, nitrate, sulfate salts or alkoxides species $Al(OR)_3$ and a silicon compound made of mixture of tetraalkoxide $Si(OR)_4$ and organotrialkoxide $R'Si(OR)_3$, wherein the molar ratio is maintained between 1 and 3.6 and the alkali/Al molar ratio is maintained 2.3 and 3. Such materials are described in French patent application FR 02/9086, hereby incorporated by reference in its entirety.

Synthetic hollow aluminosilicates are disclosed in U.S. Pat. No. 6,254,845 issued Jul. 3, 2001 to Ohashi et al, titled "synthesis Method Of spherical Hollow aluminosilicate Cluster," hereby incorporated by reference. As mentioned earlier, the method used therein results in a synthetic allophane in which powder X-ray diffraction reveals two broad peaks close to 27° and 40° at 2θ on the Cu—$K_\alpha$ line, which correspond to a non-crystalline (substantially amorphous)

structure and which is characteristic of spherical particles referred to as allophane. In some cases, allophanes have also been characterized as giving weak XRD peaks at least at about 2.2 and 3.3. The method of synthesis may affect the XRD pattern, however, and depending on the preparation, additional peaks may be present at about 7.7 to 8.4 Å and/or about 1.40 Å.

The aluminosilicate of the present invention includes materials termed "synthetic alluphane" or "allophane like." Synthetic allophane is typically in the form of substantially spherically or ring shaped aluminosilicate particles, including hollow spherical aluminosilicate particles, preferably having an average diameter of between 3.5 and 5.5 nm. In addition, synthetic allophanes, like natural allophanes, are substantially amorphous (P. Bayliss, Can. Mineral. Mag., 1987, 327), compared to, for example, imogolites which are crystalline and fibril shaped. Synthetic allophane differs from natural allophane (such as Allophosite® sold by Sigma) in that it does not contain iron. It may also be more amorphous and acidic.

In more detail, a preferred method for preparing an aluminosilicate polymer comprises the following steps:

(a) treating a mixed aluminum and silicon alkoxide only comprising hydrolyzable functions, or a mixed aluminum and silicon precursor resulting from the hydrolysis of a mixture of aluminum compounds and silicon compounds only comprising hydrolyzable functions, with an aqueous alkali, in the presence of silanol groups, the aluminum concentration being maintained at less than 1.0 mol/l, the Al/Si molar ratio being maintained between 1 and 3.6 and the alkali/Al molar ratio being maintained between 2.3 and 3;

(b) stirring the mixture resulting from step (a) at ambient temperature in the presence of silanol groups long enough to form the aluminosilicate polymer; and (c) eliminating the byproducts formed during steps (a) and (b) from the reaction medium.

The expression "hydrolyzable function" means a substituent eliminated by hydrolysis during the process and in particular at the time of treatment with the aqueous alkali. The expression "unmodified mixed aluminum and silicon alkoxide" or "unmodified mixed aluminum and silicon precursor" means respectively a mixed aluminum and silicon alkoxide only having hydrolyzable functions, or a mixed aluminum and silicon precursor resulting from the hydrolysis of a mixture of aluminum compounds and silicon compounds only having hydrolyzable functions. More generally, an "unmodified" compound is a compound that only comprises hydrolyzable substituents.

Step (c) can be carried out according to different well-known methods, such as washing or diafiltration.

The aluminosilicate polymer material obtainable by the method defined above has a substantially amorphous structure shown by electron diffraction. This material is characterized in that its Raman spectrum comprises in spectral region 200–600 $cm^{-1}$ a wide band at 250±6 $cm^{-1}$, a wide intense band at 359±6 $cm^{-1}$, a shoulder at 407±7 $cm^{-1}$, and a wide band at 501±6 $cm^{-1}$, the Raman spectrum being produced for the material resulting from step (b) and before step (c).

Alternatively, hybrid aluminosilicate polymers involving the introduction of functions, in particular organic functions into the inorganic aluminosilicate polymer enables a hybrid aluminosilicate polymer to be obtained in comparison to inorganic aluminosilicate polymers. A method for preparing a hybrid aluminosilicate polymer, comprises the following steps:

(a) treating a mixed aluminum and silicon alkoxide of which the silicon has both hydrolyzable substituents and a non-hydrolyzable substituent, or a mixed aluminum and silicon precursor resulting from the hydrolysis of a mixture of aluminum compounds and silicon compounds only having hydrolyzable substituents and silicon compounds having a non-hydrolyzable substituent, with an aqueous alkali, in the presence of silanol groups, the aluminum concentration being maintained at less than 0.3 mol/l, the Al/Si molar ratio being maintained between 1 and 3.6 and the alkali/Al molar ratio being maintained between 2.3 and 3;

(b) stirring the mixture resulting from step (a) at ambient temperature in the presence of silanol groups long enough to form the hybrid aluminosilicate polymer; and (c) eliminating the byproducts formed during steps (a) and (b) from the reaction medium.

The expression "non-hydrolyzable substituent" means a substituent that does not separate from the silicon atom during the process and in particular at the time of treatment with the aqueous alkali. Such substituents are for example hydrogen, fluoride or an organic group. On the contrary the expression "hydrolyzable substituent" means a substituent eliminated by hydrolysis in the same conditions. The expression "modified mixed aluminum and silicon alkoxide" means a mixed aluminum and silicon alkoxide in which the aluminum atom only has hydrolyzable substituents and the silicon atom has both hydrolyzable substituents and a non-hydrolyzable substituent. Similarly, the expression "modified mixed aluminum and silicon precursor" means a precursor obtained by hydrolysis of a mixture of aluminum compounds and silicon compounds only having hydrolyzable substituents and silicon compounds having a non-hydrolyzable substituent. This is the non-hydrolyzable substituent that will be found again in the hybrid aluminosilicate polymer material of the present invention. More generally, an "unmodified" compound is a compound that only consists of hydrolyzable substituents and a "modified" compound is a compound that consists of a non-hydrolyzable substituent. This material is characterized by a Raman spectrum similar to the material obtained in the previous synthesis, as well as bands corresponding to the silicon non-hydrolyzable substituent (bands linked to the non-hydrolyzable substituent can be juxtaposed with other bands), the Raman spectrum being produced for the material resulting from step (b) and before step (c).

The aluminosilicate of the present invention has several desirable properties. Most importantly, it very clearly improves print density and differential gloss, in addition to smudge resistance, in the overcoat of the present inkjet recording element. The present media is particularly advantageous in successfully managing the trade-off between humidity keep and print life.

Referring again to the hydrophilic absorbing layers under the overcoat layer, typically, dye mordants may be added to these layers in order to improve water and humidity resistance and may optionally be added to the inner layer and the base layer. However, most mordant materials adversely affect dye light stability. Any polymeric mordant can be used in the hydrophilic absorbing layer or layers of the invention provided it does not adversely affect light fade resistance unduly. Preferably, for example, there may be used a cationic polymer, e.g., a polymeric quaternary ammonium compound, such as poly(dimethylaminoethyl)-methacrylate, polyalkylenepolyamines, and products of the condensation thereof with dicyanodiamide, amine-epichlorohydrin polycondensates, lecithin and phospholipid compounds. Examples of mordants useful in the invention include vinylbenzyl trimethyl ammonium chloride/ethylene glycol dimethacrylate, vinylbenzyl trimethyl ammonium chloride/divinyl benzene, poly(diallyl dimethyl ammonium chloride), poly(2-N,N,N-trimethylammonium)ethyl methacrylate methosulfate, poly(3-N,N,N-trimethyl-ammonium)propyl methacrylate chloride, a copolymer of vinylpyrrolidinone and vinyl(N-methylimidazolium chloride, and hydroxyethyl cellulose derivitized with (3-N,N,N-trimethylammonium) propyl chloride.

Preferably, at least the inner layer and optionally both the inner layer and the base layer contains a cationic polymer comprising an effective amount of a cationic monomeric unit (mordant moiety). The cationic polymer can be water-soluble or can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyper-branched, grafted, random, blocked, or can have other polymer microstructures well known to those in the art. They also can be partially crosslinked. Examples of core/shell particles useful in the invention are disclosed in U.S. Pat. No. 6,619,797 issued Sep. 16, 2003 to Lawrence et al., titled "Ink Jet Printing Method." Examples of water-dispersible particles useful in the invention are disclosed in U.S. Pat. No. 6,454,404 issued Sep. 24, 2002 to Lawrence et al., titled "Ink Jet Printing Method," and U.S. Pat. No. 6,503,608 issued Jan. 7, 2003 to Lawrence et al., titled "Ink Jet Printing Method."

Preferably, cationic, polymeric particles comprising at least 10 mole percent of a cationic mordant moiety (monomeric unit) are employed in the inner layer and base layer.

Such cationic, polymeric particles useful in the invention can be derived from nonionic, anionic, or cationic monomers. In a preferred embodiment, combinations of nonionic and cationic monomers are employed. The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters [usually referred to as methacrylate], vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitriles, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

A particularly preferred-cationic polymer for the inner layer is a cationic polyurethane, preferably water-dispersible polyurethane polymers having the following general formula:

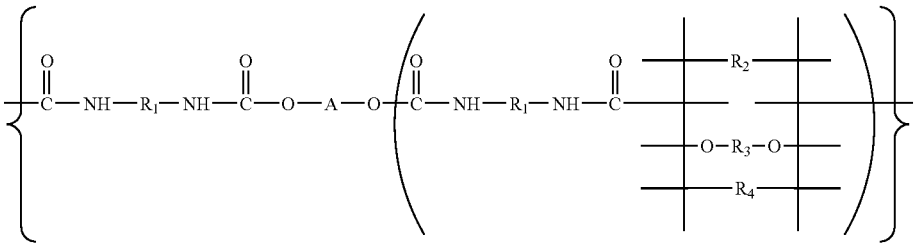

wherein:

$R_1$ is represented by one or more of the following structures:

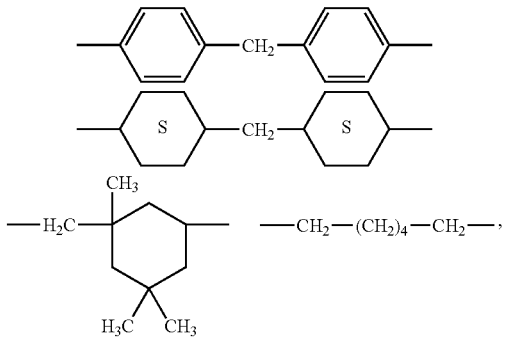

A represents the residue of a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl-propane-1,3-diol, nonane-1,9-diol or the various isomeric bis-hydroxymethylcyclohexanes, b) a polylactone such as polymers of ϵ-caprolactone and one of the above mentioned diols, c) a polycarbonate obtained, for example, by reacting one of the above-mentioned diols with diaryl carbonates or phosgene, or d) a polyether such as a polymer or copolymer of styrene oxide, propylene oxide, tetrahydrofuran, butylene oxide or epichlorohydrin. Preferably, A represents the residue of a dihydroxy polyester as in a).

$R_2$ represents the residue of a diol having a molecular weight less than about 500, such as the diols listed above for A, and $R_3$ represents a monomeric unit comprising a cationic moiety, typically a quaternized ammonium salt, for example, wherein —$OR_3O$— is a residue of N,N-bis(hydroxyethyl) N,N-dimethyl quaternary ammonium methane sulfonate and higher ethoxylated derivatives formed by the reaction of tertiary amine with ethylene oxide, as disclosed, for example, in EP 0718276 B1 and EP 0718 276 B1.

$R_4$ is the residue of a diamine having a molecular weight less than about 500, such as ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, 4,4'-methylenebis(2-chloroaniline), 3,3'-dichloro-4,4'-biphenyl diamine, 2,6-diaminopyridine, 4,4'-diamino diphenylmethane, and adducts of diethylene triamine with acrylate or its hydrolyzed products. These materials are preferred due to their availability and compatibility with the present invention.

The polyurethane employed in the invention preferably has a Tg between about −50° C. and 100° C. A plasticizer may also be added if desired. In a preferred embodiment of the invention, the polyurethane has a number average molecular weight of from about 5,000 to about 100,000, more preferably from 10,000 to 50,000. The water-dispersible polyurethane employed in the invention may be prepared as described in "Polyurethane Handbook," Hanser Publishers, Munich Vienna, 1985. Polyurethanes with these properties are readily available and effective in the present invention. An example of an water-dispersible polyurethane that may be used in the inner layer of the invention is Witcobond® 213 (Witco Corporation).

A preferred cationic polymer for the base layer is a cationic acrylic polymer. For example, Glascol® R-350 (Ciba) is an acrylic latex that is preferably used in its solubilized form by lowering the pH sufficiently. A preferred cationic acrylic polymer comprises alkyl methacrylate such as methyl or ethyl (meth)acrylate and dialkylaminoalkyl (meth)acrylates such as 2-trimethylammonium ethyl acrylate and/or methacrylate. Cationic acrylic polymers are also disclosed in EP 0216 479 B2 to Farrar (Allied Colloids Limited).

The water insoluble, cationic, polymeric particles employed in this invention can be prepared using conventional polymerization techniques including, but not limited to bulk, solution, emulsion, or suspension polymerization. They are also commercially available usually from a variety of sources.

The amount of water insoluble, cationic, polymeric particles used, especially in the inner layer, should be high enough so that the images printed on the recording element will have a sufficiently high density. In a preferred embodiment of the invention, the cationic, polymeric particles are used in the amount of 2 to 30 weight percent solids, preferably 5 to 15 weight percent in the base layer and 15 to 30 weight percent in the inner layer.

Examples of other water insoluble, cationic, polymeric particles which may be used in the invention include those described in U.S. Pat. No. 3,958,995, hereby incorporated by reference in its entirety. A specific examples of these polymers include, for example, a copolymer of (vinylbenzyl)trimethylammonium chloride and divinylbenzene (87:13 molar ratio); a terpolymer of styrene, (vinylbenzyl) dimethylbenzylamine and divinylbenzene (49.5:49.5:1.0 molar ratio); and a terpolymer of butyl acrylate, 2-aminoethylmethacrylate hydrochloride and hydroxyethylmethacrylate (50:20:30 molar ratio).

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated or poly(ethylene terephthalate) paper is employed.

The support used in the invention may have a thickness of from 50 to 500 μm, preferably from 75 to 300 μm. Antioxidants, antistatic agents, plasticizers and other known additives may be incorporated into the support, if desired.

In order to improve the adhesion of the base layer or, in the absence of a base layer, the inner layer or image-receiving layer, to the support, the surface of the support may be subjected to a corona-discharge treatment prior to applying a subsequent layer. The adhesion of the ink recording layer to the support may also be improved by coating a subbing layer on the support. Examples of materials useful in a subbing layer include halogenated phenols and partially hydrolyzed vinyl chloride-co-vinyl acetate polymer. In order to impart mechanical durability to an ink recording element, crosslinkers, which act upon the binder discussed above, may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

In another embodiment of the invention, a filled layer containing light scattering particles such as titania may be situated between a clear support material and the ink receptive multilayer described herein. Such a combination may be effectively used as a backlit material for signage applications. Yet another embodiment which yields an ink receiver with appropriate properties for backlit display applications results from selection of a partially voided or filled poly (ethylene terephthalate) film as a support material, in which the voids or fillers in the support material supply sufficient light scattering to diffuse light sources situated behind the image.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro-crystalline cellulose, zinc oxide, talc, and the like. The filler loaded in the backing layer is generally less than 5 percent by weight of the binder component and the average particle size of the filler material is in the range of 5 to 30 μm. Typical binders used in the backing layer are polymers such as polyacrylates, gelatin, polymethacrylates, polystyrenes, polyacrylamides, vinyl chloride-vinyl acetate copolymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octylsulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

While not necessary, the hydrophilic material layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758.

The following example is provided to illustrate the invention.

Preparation 1

This example illustrates the preparation of a an aluminosilicate that can be employed in the present invention. Osmosed water in the amount of 100 1 was poured into a plastic (polypropylene) reactor. Then, 4.53 moles $AlCl_3$, $6H_2O$, and then 2.52 moles tetraethyl orthosilicate were added. This mixture was stirred and circulated simultaneously through a bed formed of 1 kg of glass beads, 2-mm diameter, using a pump with 8–1/min output. The operation to prepare the unmodified mixed aluminum and silicon precursor took 90 minutes. Then, 10.5 moles NaOH 3M were added to the contents of the reactor in two hours. Aluminum concentration was $4.4\times10^{-2}$ mol/l, Al/Si molar ratio 1.8 and alkali/Al ratio 2.31. The reaction medium clouded. The mixture was stirred for 48 hours. The medium became clear. The circulation was stopped in the glass bead bed. The aluminosilicate polymer material according to the present invention was thus obtained in dispersion form. Finally, nanofiltration was performed to pre-concentration by a factor of 3, followed by diafiltration using a Filmtec® NF 2540 nanofiltration membrane (surface area 6 $m^2$) to eliminate the sodium salts to obtain an Al/Na ratio greater than 100. The retentate resulting from the diafiltration by nanofiltration was concentrated to obtain a gel with about 20% by weight of aluminosilicate polymer.

Preparation 2

Another example of the preparation of aluminosilicate particles was as follows. Demineralized water in the amount of 56 kg was poured into a glass reactor. Then, 29 moles $AlCl_3.6H_2O$, were dissolved in the water and the reactor was heated to 40° C. Then, 19.3 moles tetraethyl orthosilicate were added. This mixture was stirred for 15 minutes. Next, 74.1 moles of triethylamine were metered into the mixture in 75 minutes. The mixture was allowed to stir overnight. The mixture was diafiltered with a 20K MWCO spiral wound polysulfone membrane (Osmonics® model S8J) until the conductivity of the permeate was less than 1000 μS/cm. The reaction mixture was then concentrated by ultrafiltration. The yield was 41.3 kg at 6.14% solids (95%).

EXAMPLE 1

Solution for Control Overcoat 1—A liquid solution was made by dissolving a partially hydrolyzed polyvinyl alcohol (KH-17® from Nippon Gohsei) in water and adding two coating surfactants (Olin 10G® from Olin Corp. and Zonyl FS300® from Dupont Corp.) with the ratios of dry chemicals being 100 parts KH17® to 3 parts Olin 10G and 3 part Zonyl FSN®. The solution is made at 10% solids in water.

Solution for Invention Overcoat 2—Prepared in the same way as the Control Overcoat 1 except that particles of an aluminosilicate such as prepared above is added to the melt with the ratios of the dry chemicals being 97.5 parts KH17® to 2.5 parts aluminosilicate to 3 parts Olin 10G® and 3 part Zonyl FSN®. The solution is made at 10% solids in water.

Solution for Invention Overcoat 3—Prepared in the same way as the Control Overcoat except that the aluminosilicate is added to the melt with the ratios of the dry chemicals being 95 parts KH17® to 5 parts aluminosilicate to 3 parts Olin 10G® and 3 part Zonyl FSN®. The solution is made at 10% solids in water.

Inner layer solution for Inner Layer 1—A liquid solution was made by dissolving a partially hydrolyzed polyvinyl alcohol (Elvanol 52-22® DuPont) and adding a cationic polyurethane dispersion (Witcobond 213® from Crompton Corp.) with the weight ratios of the dry-chemicals being 88.25 parts Elvanol 52-22® to 19.75 parts Witcobond 213® polyurethane. The solution is made at 10% solids in water.

Base layer solution for Base Layer 1—A liquid solution was made by dissolving a pigskin gelatin (commercially available from Nitta Gelatine Company) and adding a cationic mordant (Glascol R-350® commercially available from Ciba) that has been pH adjusted to 4.7 with acetic acid and adding 12 μm polystyrene polymer beads with the ratios of dry chemicals being 92 parts pigskin gelatin to 7.5 parts Glascol R-350® polymer to 0.5 parts 12 μm beads. The solution is made at 10% solids in water.

Control Recording Element—Control element is created by simultaneously coating the layers on a corona discharge treated polyethylene resin coated paper using a slide hopper and dried thoroughly by forced air heat after application of the coating solutions. Solution for Base Layer 1 is coated directly on the paper with the coating of the solution for the Inner Layer 1 on top of Base Layer 1 and the solution for Overcoat 1 coated on top of Inner Layer 1 to yield dry thicknesses of 10 μm for the Base Layer 1 layer, 1.75 μm for the Inner Layer 1 and 1.75 μm for the Overcoat Layer 1.

Invention Recording Element 1—This element was prepared exactly the same as for the Control Recording Element except the solution for Overcoat Layer 2 is used in replacement of the solution for Overcoat Layer 1.

Invention Recording Element 2—This element was prepared exactly the same as for the-Control Recording Element except that the solution for Overcoat Layer 3 is used in replacement of the solution for Overcoat Layer 1.

Testing: A test pattern was created in Corel Draw® software. A total of eight 0.5 inch square patches were created specifying 0% coverage (Dmin) and 100% coverage for the following colors: cyan, magenta, yellow, red, green, blue and black. The above coatings were printed with a HP 5550® desktop inkjet printer and tested for differential gloss (measured as the standard deviation of gloss of dmin, cyan, magenta, yellow, red, green, blue and black color patches) at 20 and 60 degrees using a BYK® Triglossmeter. A 20-degree differential gloss more than 12 is unacceptable. A 60-degree differential gloss more than 8 is unacceptable.

Optical reflection density was measured (average of cyan, magenta, yellow, red, green, and black color patches) using a densitometer. Dry smudge is the propensity of cyan, magenta, yellow, red, green, and black color patches to smudge after rubbing the patches with a finger immediately after printing. Smudge was measured on a scale of 0–2 where 0 signifies no smudging. A dry smudge greater than 1 is unacceptable. The results of testing the above-described recording elements are shown in Table 1 below.

TABLE 1

| Coating | 20 deg differential gloss | 60 deg differential gloss | Density | Dry smudge |
|---|---|---|---|---|
| Control element | 13.6 | 9.2 | 1.73 | 1.5 |
| Invention element 1 | 11 | 6 | 1.75 | 0 |
| Invention element 2 | 11 | 5.3 | 1.77 | 0.5 |

The results show that the control element is unacceptable for differential gloss and dry smudge. The two invention elements are more than acceptable.

The invention claimed is:

1. An inkjet recording element comprising a support having thereon, in order, at least one hydrophilic absorbing layer and a polymeric non-porous overcoat layer comprising, in a binder, an effective amount of particles of a synthetic, substantially amorphous aluminosilicate material having an average diameter of 1 to 10 nm, which particles comprise substantially spherical or ring-shaped particles, wherein the aluminosilicate material exhibits an X-ray diffraction pattern that comprises weak peaks at about 2.2 and 3.3 Å.

2. The recording element of claim 1 wherein the binder comprises poly(vinyl alcohol).

3. The recording element of claim 1 wherein the inkjet recording element further comprises an inner layer comprising a cationic polymer and a hydrophilic binder.

4. The recording element of claim 3 wherein the inkjet recording element further comprises a base layer located between the inner layer and the support.

5. The recording element of claim 3 wherein the cationic polymer in the inner layer is a polyurethane.

6. The recording element of claim 5 wherein the weight ratio of poly(vinyl alcohol) to polyurethane is between 60:40 and 95:10.

7. The recording element of claim 1 wherein the aluminosilicate particles are substantially in the form of a hollow sphere.

8. The recording element of claim 1 wherein the aluminosilicate material is a synthetic allophane with essentially no iron atoms.

9. The inkjet recording element of claim 1 wherein the aluminosilicate material is a synthetic allophane having a positive charge.

10. The recording element of claim 1 wherein the particles comprise a polymeric aluminosilicate having the formula:

$$Al_xSi_yO_a(OH)_b.nH_2O$$

where the ratio of x:y is between 0.5 and 4, a and b are selected such that the rule of charge neutrality is obeyed; and n is between 0 and 10.

11. The recording element of claim 1 wherein the aluminosilicate material comprises organic groups.

12. The recording element of claim 10 wherein said aluminosilicate has the formula:

$$Al_xSi_yO_a(OH)_b.nH_2O$$

where the ratio of x:y is between 1 and 3.6, and a and b are selected such that the rule of charge neutrality is obeyed; and n is between 0 and 10.

13. The recording element of claim 1 wherein the average particle size of the particles is in the range from about 3 nm to about 6 nm.

14. The recording element of claim 1 wherein the particles are hollow spheres.

15. The recording element of claim 1 wherein the particles are present in an amount of 1 to 10 weight percent solids.

16. An inkjet recording element comprising a support having thereon, in order, at least one hydrophilic absorbing layer and a polymeric overcoat layer comprising, in a binder, fine particles of a synthetic, substantially amorphous aluminosilicate material having an average diameter of 1 to 10 nm, which particles are present in the overcoat layer an amount of 1 to 10 weight percent solids and comprise substantially spherical hollow spheres, wherein the material is represented by the formula:

$$Al_xSi_yO_a(OH)_b.nH_2O$$

where the ratio of x:y is between 1 and 3.6, and a and b are selected such that the rule of charge neutrality is obeyed; and n is between 0 and 10 wherein the aluminosilicate exhibits an X-ray diffraction pattern that comprises weak peaks at about 2.2 and 3.3 Å.

17. The recording element of claim 16 wherein the overcoat layer comprises binder in the amount of at least 80 weight percent based on total solids.

18. An ink jet printing method, comprising the steps of:

A) providing an ink jet printer that is responsive to digital data signals;

B) loading said printer with the ink jet recording element of claim 1;

C) loading said printer with an ink jet ink; and

D) printing on the ink jet recording element using said ink jet ink in response to said digital data signals.

19. An inkjet recording element comprising one or more non-porous, swellable hydrophilic absorbing layers, comprising a support having thereon, in order, at least one hydrophilic absorbing layer and a polymeric overcoat layer comprising, in a binder, an effective amount of particles of a synthetic, substantially amorphous aluminosilicate material having an average diameter of 1 to 10 nm, which particles comprise substantially spherical or ring-shaped particles, wherein the aluminosilicate material exhibits an X-ray diffraction pattern that comprises weak peaks at about 2.2 and 3.3 Å, and wherein the overcoat layer is non-porous and comprises binder in the amount of at least 80 weight percent based on total solids, and wherein the inkjet recording element further comprises an inner layer comprising a cationic polymer and a hydrophilic binder and a base layer located between the inner layer and the support.

* * * * *